US006321057B1

(12) United States Patent
Yamamoto

(10) Patent No.: US 6,321,057 B1
(45) **Date of Patent: *Nov. 20, 2001**

(54) DEVELOPING APPARATUS WHEREIN A DEVELOPER CLOUD COATS A DEVELOPER BEARING MEMBER

(75) Inventor: Takeshi Yamamoto, Yokohama (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/387,797

(22) Filed: Sep. 1, 1999

(30) Foreign Application Priority Data

Sep. 3, 1998 (JP) ..... 10-265692

(51) Int. Cl.[7] ..... G03G 15/08

(52) U.S. Cl. ..... 399/281; 399/272

(58) Field of Search ..... 399/281, 266, 399/290, 291, 272

(56) References Cited

FOREIGN PATENT DOCUMENTS 5-27575 * 2/1993 (JP) .
5-197275 * 8/1993 (JP) .
7-281524 * 10/1995 (JP) .
8-146767 * 6/1996 (JP) .
9-090735 * 4/1997 (JP) .
9-292767 * 11/1997 (JP) .

* cited by examiner

*Primary Examiner*—Quana M. Grainger
(74) *Attorney, Agent, or Firm*—Fitzpatrick, Cella, Harper & Scinto

(57) ABSTRACT

A developing apparatus in which a developer borne on a developer bearing body contacts an image bearing body at a developing portion. The developer is provided in a noncontact manner in the form of a developer cloud to the developer bearing body.

24 Claims, 6 Drawing Sheets

DEVELOPING APPARATUS WHEREIN A DEVELOPER CLOUD COATS A DEVELOPER BEARING MEMBER

BACKGROUND OF THE INVENTION

1. Field of the Invention

The present invention relates to a developing apparatus used for an image forming apparatus such as an electrophotographic apparatus and an electrostatic recording apparatus.

2. Related Background Art

In an image forming apparatus using an electrophotographic system, an electrostatic latent image is formed on an image bearing body, which is developed into a toner image to be visualized, and then, the toner image is transferred onto a transfer material to obtain an image.

In general, such developing methods include a one-component developing method using a one-component developer made of only a magnetic toner, and a two-component developing method using a two-component developer made of a magnetic particle (magnetic carrier) and a toner. The one-component developing method has such merits that the structure of a developing apparatus is simple and maintenance is easy, so that a variety of such developing apparatuses have been proposed and have been put into practical use.

There has also been proposed a developing method by a nonmagnetic, one-component developer made of only a nonmagnetic toner as disclosed in Japanese Patent Application Laid-open No. 58-116559, and such a developing apparatus is put into practical use that it can cope with colorization of an image in recent years and can obtain a high quality color image, while it is inexpensive and small.

FIG. 8 shows an example of a nonmagnetic, one-component developing apparatus. As shown in FIG. 8, in the developing apparatus, a developing roller 1 made of an elastic roller is set as a developer bearing body in a developer container 3 containing a nonmagnetic toner of a nonmagnetic, one-component developer, and a toner supplying roller 14 as a developer supplying member and a regulating blade 13 as a developer regulating member are set to abut against the developing roller 1.

The developing roller 1 includes a solid rubber-like elastic layer having a hardness of about 30 to 70° in asker C hardness, and is rotatively driven in a direction indicated by an arrow while being in contact with the photosensitive drum 11. A coating material for more effectively performing electric charge application to the toner may be provided on the surface of the developing roller 1. Incidentally, since the toner is borne on the surface of the developing roller 1, the developing roller 1 is not in direct contact with the photosensitive drum 11. However, in this specification, the recitation "the developing roller 1 is in contact with the photosensitive drum 11" includes such a state.

The toner supplying roller 14 is formed by coating the outer surface of a core metal 14*a* of SUS or the like with an elastic member 14*b* of urethane foam or the like. The roller 14 rotates while rubbing or sliding frictionally against the developing roller 1, so that the nonmagnetic toner contained in the developer container 3 is supplied to the surface of the developing roller 1. The roller 14 has also a function to scrape the nonmagnetic toner, which has not contributed to development at a developing portion opposite to the photosensitive drum 11 and has been returned to the developer container 3 with the rotation of the developing roller 1, from the surface of the developing roller 1.

The regulating blade 13 is made of a metal plate of, for example, a stainless metal plate with a thickness of about 0.1 to 0.5 mm, and is disposed to contact with the surface of the developing roller 1 at a pressure (linear pressure) of about 5 to 100 g/cm, so that the toner borne on the developing roller 1 is regulated to form a thin layer of toner, and a friction charging electric charge is applied to the toner.

By the foregoing structure, the developing apparatus makes it possible to excellently form the thin layer of the charged nonmagnetic toner on the developing roller 1 and to supply the toner for development of an electrostatic latent image formed on the surface of the photosensitive drum 11, so that excellent development of the latent image becomes possible.

However, in the foregoing nonmagnetic, one-component developing apparatus, the latent image is developed in the state where the developing roller 1 abuts against the photosensitive drum 11 and the toner is rubbed. Also in the developer container 3, the toner supplying roller 14 abuts against the developing roller 1, so that the toner is rubbed and is supplied to the developing roller 1, and then the toner on the developing roller 1 is collected. Further, application of the electric charge to the toner is mainly performed by contact friction when the toner passes through the regulating blade 13.

From these, in the nonmagnetic, one-component developing apparatus, before a toner in the developer container 3 is used for development at the photosensitive drum 11, an extremely large mechanical load is applied to the toner, so that damage of the toner is very serious as compared with other developing methods.

Further, depending upon the arrangement position or rotation direction of the toner supplying roller 14, there may be a case where the toner, which has not contributed to development, can not be completely collected so that the toner remains on the developing roller 1. The toner remaining on the developing roller 1 again passes through the regulating blade 13 and is carried to the development region. If such re-carrying is repeatedly performed, an external additive and the like for controlling a charging amount or fluidity of the toner is embedded into the toner by mechanical friction or heat accumulation received at each time, and the toner is deteriorated, so that desired charging characteristics and fluidity cannot be obtained.

Such a deteriorated toner causes many troubles in an image forming process. For example, in the case where the deteriorated toner is used for development, suitable developing characteristics cannot be obtained, so that there is a case where development failure may occur, a case where a void is produced in an image at the time of transfer, or the like. Further, supply of a new toner to the developing roller 1 is blocked, and an application amount of the toner onto the developing roller 1 may be lowered, so that density failure may be caused. When the deteriorated toner is fused to a nip portion between the regulating blade 13 and the developing roller 1 or to the surface of the developing roller 1, a poor toner coat such as a streak occurs on the developing roller 1, and electric charge application to the toner newly supplied to the developing roller 1 is hindered. By this, a noncharged toner is fed to the development region, so that bad quality of an image, such as fog and unevenness, may occur.

Besides, in the nonmagnetic, one-component developing apparatus, not only a load applied to the toner is large, but also a load applied to the developing apparatus itself is large. For example, with respect to the toner supplying roller 14, in the case where it is formed of the sponge type roller as described above, if rubbing against the developing roller 1 continues for a long time, wear occurs and damage of the toner supplying roller 14 itself, clogging of the toner, and the like, so that excellent supply and collection of a toner becomes impossible.

In this way, although the nonmagnetic, one-component developing apparatus has a simple structure and an excellent developed image can be obtained. The load applied to the toner and the apparatus is high, so that as compared with a magnetic one-component developing apparatus or a two-component developing apparatus, long stability is poor. Thus, the nonmagnetic, one-component is mainly used for a cartridge type developing apparatus in which the whole developing apparatus is replaced when the toner is consumed, and it is seldom used with a developing apparatus of a type wherein the toner is replenished.

Besides, in recent years, for the purpose of reducing consumed electric power, realization of a toner which can be fixed at a lower temperature is desired, and a developing apparatus having a developing process of low stress corresponding to the toner for low temperature fixation is demanded.

SUMMARY OF THE INVENTION

An object of the present invention is to provide a developing apparatus in which a load applied to a developer is reduced.

Another object of the present invention is to provide a developing apparatus which comprises a developer bearing body for bearing a developer and carrying the developer to a developing portion, the developer borne on the developer bearing body contacting with an image bearing body at the developing portion; and developer supplying means being provided in a noncontact manner to the developer bearing body, for supplying the developer to the developer bearing body.

Still another object of the present invention is to provide a nonmagnetic, one-component developing apparatus which can cope with a toner for low temperature fixation and which can realize low stress coat such that a load applied to the toner, especially a load at the time of electric charge application and at the time of supply to a developing roller is remarkably reduced, and further, which can perform coating of a toner without a reversal toner or noncharged toner, and can be used for a long term as a toner replenishment type.

Objects of the present invention other than the above and features of the present invention will become more apparent by reading the following detailed description with reference to the accompanying drawings.

DESCRIPTION OF THE PREFERRED EMBODIMENTS

Preferred embodiments of the present invention will be described below with reference to the drawings.

Embodiment 1

Figure 1:
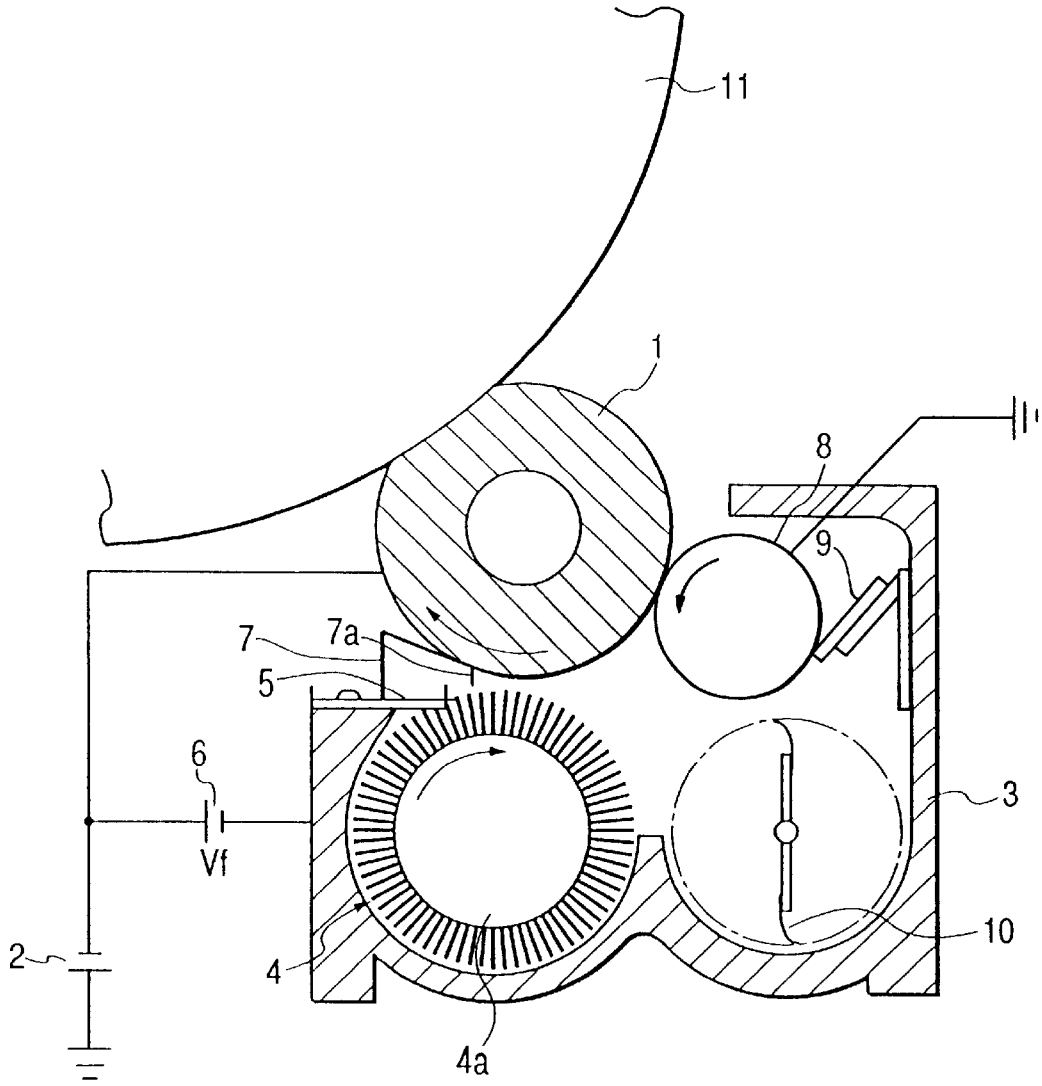
FIG. 1 is a sectional view showing a developing apparatus according to an embodiment of the present invention.

FIG. 1 is a sectional view showing a developing apparatus according to an embodiment of the present invention.

As shown in FIG. 1, the developing apparatus of this embodiment includes a developer container 3 containing a nonmagnetic toner of a one-component developer, and includes a developing roller 1 having elasticity as a developer bearing body at an opening portion of the developing container 3 opposite to a photosensitive drum 11. The developing roller 1 elastically abuts against the photosensitive drum 11 and rotates in a direction indicated by an arrow. A developing bias of DC voltage is applied from a power source 2 to the developing roller 1.

In relation to this developing roller 1, a toner supplying brush 4, a toner flow passage controlling member 5, and a toner regulating member (elastic blade) 7 are set. Further, a toner collecting roller 8 is set behind the developing roller 1 when seen from the opening portion of the developer container 3, and an agitating member 10 is set below the toner collecting roller 8. A scraper 9 is made to abut against the toner collecting roller 8.

Figure 2:
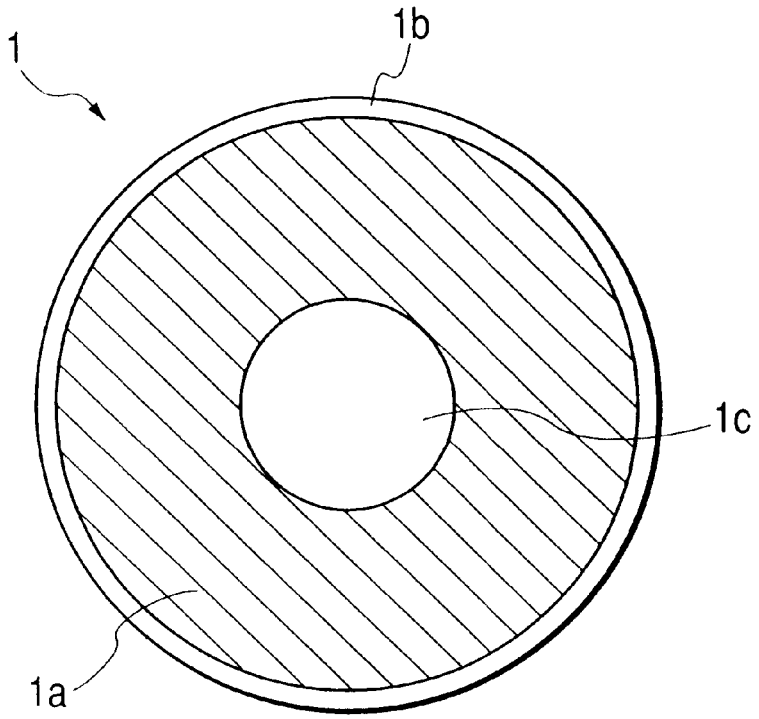
FIG. 2 is a sectional view showing a developing roller which is set in the developing apparatus of FIG. 1.

As shown in FIG. 2, the developing roller 1 is made of an elastic roller in which an elastic layer 1*a*is provided on a core metal 1*c*. As a material of the elastic layer 1*a*, a general rubber material such as silicone rubber, NBR rubber, EPDM rubber, and urethane rubber can be used. In this embodiment, silicone rubber is used for the elastic layer 1*a*. Further, in view of a property of electric charge application to the toner, the surface of the elastic layer 1*a* is coated with a conductive resin film 1*b* by dispersing carbon or the like in resin such as nylon. This conductive resin film 1*b* has a higher charge application property to the developer than that of the elastic layer 1*a*.

It is suitable that the rubber hardness of the elastic layer 1*a* is about 20 to 70° through measurement including the conductive resin film 1*b* by a JISA rubber hardness meter. If the rubber hardness of the elastic layer 1*a* is as high as more than 70°, a contact area to the photosensitive drum 11 becomes small, so that it becomes difficult to perform satisfactory development. Besides, if the rubber hardness of the elastic layer 1*a* is high, an intrusion amount on the surface of the developing roller 1 varies when the developing roller 1 is made to abut against the photosensitive drum 11, and its abutment force can be greatly changed, which is not preferable. On the other hand, if the rubber hardness of the elastic layer 1*a* is as low as less than 20°, the compression eternal distortion of rubber becomes large and the elasticity of rubber is lost because of being left as it is or the like, so that there is a fear that the elastic layer 1*a* is deformed.

It is preferable that the surface of the elastic layer 1*a* has a surface roughness Rz of 3 to 20 $\mu$m in view of a property of carrying the toner, and it is specifically set in accordance with the particle diameter and shape of the toner used. In this embodiment, although the conductive resin film 1*b* is provided on the surface of the elastic layer 1*a,* this resin film 1*b* is as extremely thin as about 10 μm, so that the surface roughness set to the elastic layer 1 *a* is directly reflected as the surface roughness of the developing roller 1.

It is preferable that the electric resistance of the developing roller 1 is as low as possible so that a reverse polarity charge generated at the time of charging by contact abrasion against the toner may not remain on the surface of the roller. However, pinholes often exist on the surface of the photosensitive drum 11, and in this case, an electric leak can be caused at a nip portion between the developing roller 1 and the photosensitive drum 11 at the time of development. Thus, it is preferable that the resistance of the developing roller 1 is set at a volume resistance of about $10^3$ to $10^9$ Ωcm in total including the conductive resin film 1*b*.

The toner supplying brush 4 is for supplying the nonmagnetic toner contained in the developer container 3 to the developing roller 1, is arranged substantially below the developing roller 1 with a distance of about 100 μm to 1 mm therefrom, and is disposed rotatably in the same direction i.e., the direction in which the brush moves in the opposite direction at the closest portion to the developing roller 1) as the rotation direction of the developing roller 1. A power source 6 for applying a bias is connected to a core metal of the toner supplying brush 4, and a desired voltage of the developing bias superposed with DC voltage Vf is applied.

Figure 3A:
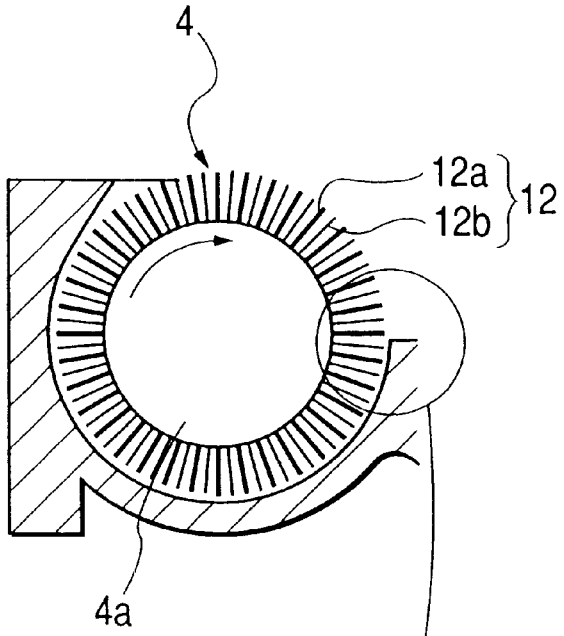
FIGS. 3A and 3B are views showing a toner supplying brush which is set in the developing apparatus of FIG. 1 and its fibers.
Figure 3B:
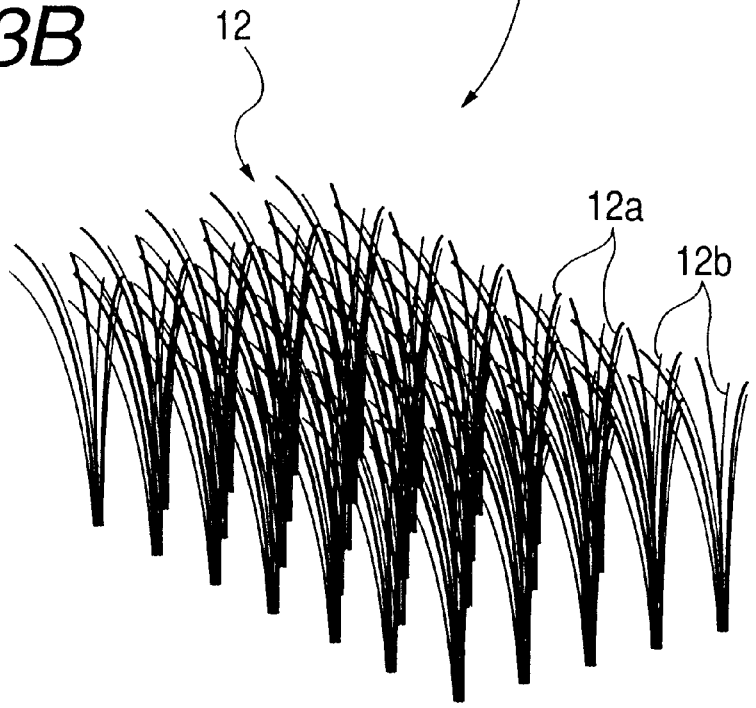

According to this embodiment, as shown in FIGS. 3A and 3B, the toner supplying brush 4 is made of a fur brush (brush roller) in which a brush member 12 including a mixture of two kinds of a low resistance conductive fiber 12*a* with a volume resistance of $10^2$ to $10^8$ Ωcm and a high resistance insulative fiber 12*b* with a volume resistance of $10^8$ to $10^{15}$ Ωcm are wound on a core metal 4*a* of SUS or the like.

In this embodiment, as the nonmagnetic toner, a toner of negative charging property is used. Thus, as the insulative fiber 12*b,* it is preferable to use one having a positive charging property, and a nylon fiber (volume resistance of $10^8$ to $10^{15}$ Ωcm) is used in this embodiment. However, the insulative fiber 12*b* is not limited to this, but a suitable one may be selected among various fibers having insulative properties according to the characteristic of the toner. In the case of this embodiment, even a fiber of rayon or the like can be used.

Figure 4:
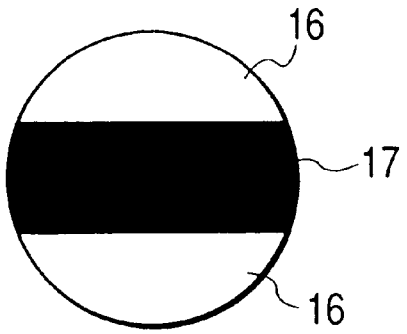
FIG. 4 is a sectional view showing a conductive fiber constituting one part of the brush fibers of FIGS. 3A and 3B.

Although a first condition of the conductive fiber 12*a* is to satisfy the above volume resistance range of $10^2$ to $10^8$ Ωcm, many of the conductive fibers are manufactured in such a manner that a conductive agent such as carbon is dispersed in an undiluted solution before spinning of insulative fibers, and the undiluted solution is formed into fibers by spinning. As shown in FIG. 4, in the conductive fiber 12*a,* a single fiber (monofilament) of an insulative fiber is constructed such that a conductive portion 17 is dispersed in an insulating portion 16. Although various methods of dispersing conductive agents may be used, the conductive portion 17 does not necessarily cover all the surface of the insulating portion 16 of the monofilament. Thus, when consideration is given to the fact that an exposed portion of the surface of the monofilament where the conductive portion 17 does not exist can come in contact with the toner, it is preferable to use, as an insulative fiber material, a material of positive charging property with respect to the toner. In this embodiment, nylon is used as an insulative fiber material used for the conductive fiber 12*a*.

In this embodiment, it is necessary that both the conductive fiber 12*a* and the insulative fiber 12*b* have elasticity so as to make a toner into a cloud as described later. For that purpose, such setting was made that both had a weaving degree (thickness) of about 1 to 10 denier/filament, an implant density (flocking density) of 10,000 to 200,000 pieces/inch$^2$ in a mixed state of those, and a pile length of 1 to 10 mm.

The toner flow passage controlling member 5 makes the toner borne by the toner supplying brush 4 into a cloud, and flicks the toner out toward the developing roller 1. The toner flow passage controlling member 5 is provided at a portion of the developer container 3 below the developing roller 1 so as to come in contact with the toner supplying brush 4. In this embodiment, as the toner flow passage controlling member 5, thin metal plate of SUS, phosphor bronze, or the like with a thickness of 100 μm to 1 mm is used.

This toner flow passage controlling member 5 is not limited to the straight shape as shown in the drawing, but the shape may vary according to the direction in which the toner is made into the cloud. Besides, in view of charge application to the toner lying on a contact surface of the toner supplying brush 4, a contact surface of the toner flow passage controlling member 5 against the brush 4 may be provided with a layer of a resin with high charge application capability to the toner, for example, a nylon resin layer in which carbon is dispersed to increase volume resistance up to $10^5$ Ωcm at an upper limit. If such a way is adopted, charge application to the toner becomes stable.

The toner regulating member 7 is for regulating the layer thickness of the toner applied to the developing roller 1, and is provided at the toner flow passage controlling member 5, elastically abutting against the developing roller 1. In this embodiment, the toner regulating member 7 is made of a stainless metal thin plate with a thickness of 0.1 mm, and is formed into such a shape that a tip of a portion extending from the toner flow passage controlling member 5 and being bent in the direction of the developing roller 1 is bent at a position about 2 mm away from the tip in the direction opposite to the developing roller 1. A bent portion 7*a* is made to bite and to abut against the developing roller 1. The abutting pressure of this toner regulating member 7 was set at about 30 g/cm in linear pressure.

It is to be noted that the toner regulating member 7 is not limited to the thin metal plate as described above, but for example, such a modification may be made that a rubber elastic material having a JISA hardness of 50° to 70°, such as urethane rubber, silicone rubber, is used, and abuts against the developing roller 1 at a linear pressure of 5 to 50 g/cm to regulate a toner layer.

The toner collecting roller 8 electrically strips off and bears a development residual toner which has not contributed to development on the developing roller 1, so that the toner is collected into the developer container 3 and is again returned to a developing step. The toner collecting roller 8 is disposed proximate to the developing roller 1, and is rotated in the reverse direction (same direction at the closest portion) to the rotation direction of the developing roller 1.

In this embodiment, such a structure is adopted that a metal cylinder with a mirror surface is used as the toner collecting roller 8, and is electrically grounded. However, in view of a release property to the toner torn off from the developing roller 1, a layer of fluorine resin such as Teflon with a thickness of about 2 μm to 50 μm may be provided on the surface of the collecting roller 8. The addition of such a resin layer has the function of preventing a leak in the case where an extremely high electric field is applied between the developing roller 1 and the collecting roller 8, which is preferable. A predetermined voltage may be applied to the collecting roller 8 according to the release property to the toner.

The scraper 9 is for scraping the development residual toner torn off from the developing roller 1 and borne on the collecting roller 8 from the surface of the collecting roller 8, and is made to abut against the lower surface of the collecting roller 8 so that the scraped toner falls onto the agitating member 10.

The agitating member 10 is rotated so that the nonmagnetic toner contained in the developer container 3 is supplied to the toner supplying brush 4 while being agitated.

This embodiment uses such a nonmagnetic toner that a coloring agent is mixed, dispersed and pulverized in a thermosetting resin, a particle diameter in weight average of which is 5 $\mu$m or more. As the thermosetting resin, a resin of polystyrene or polyester having a negative charging property is used. Further, a negative charging control agent is contained in the nonmagnetic toner.

The developing method adopts an image exposure-reversal developing system in which the surface of the photosensitive drum 11 is negatively charged by charging means (not shown), image exposure is made by an exposure means (not shown) to form an electrostatic latent image, and a negative DC voltage as a developing bias is applied to the developing roller 1 by the power source 2, so that a negative nonmagnetic toner is attached to the latent image (exposure portion), that is, which is a system in which reversal development is made. As the photosensitive drum 11, an OPC photosensitive member is used.

Figure 5:
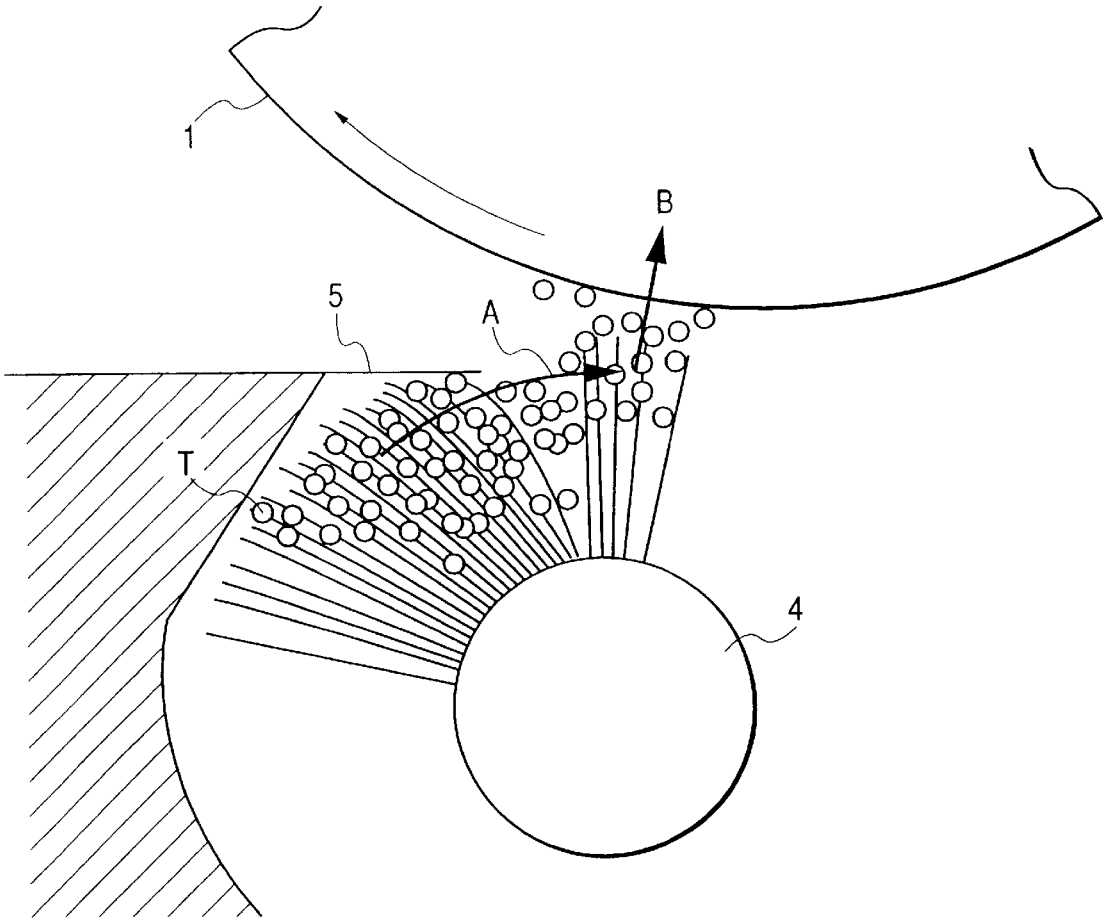
FIG. 5 is an explanatory view showing a toner supplying method in the developing apparatus of FIG. 1.

The nonmagnetic toner contained in the developer container 3 is carried to the toner supplying brush 4 while being agitated by the agitating member 10, and is negatively charged through contact with the fibers of the brush 4. The toner is attached to and born by the portion between the fibers of the toner supplying brush 4 and the surfaces of the fibers by mirror force or the like, and is carried in the direction of the toner flow passage controlling member 5 with the rotation of the brush 4. The toner carried to the contact portion with the toner flow passage controlling member 5 comes in contact with the controlling member 5, so that an electric charge is stably applied. Further, as shown in FIG. 5, after passing through the controlling member 5, the toner is flicked out by elastic force of the fiber in the rotation direction of the brush 4 as indicated by an arrow A, and forms a cloud and flies in the space between the brush 4 and the developing roller 1.

When the toner supplying brush 4 is brought into contact with the flow passage controlling member 5 to flick out the toner in the brush fibers, a noncharged toner and the like are also flicked out from the portion between the brush fibers and are prevented from remaining. Thus, there is a merit that clogging of the brush fibers by the noncharged toner and the like can also be prevented.

With respect to the flying cloud-like toner, an electric field is formed between the toner supplying brush 4 and the developing roller 1 by the developing bias applied to the developing roller 1 from the power source 2 and the bias applied to the brush 4 from the power source 6. The flying toner is attracted by this electric field toward the developing roller 1 and is born.

Figure 6:
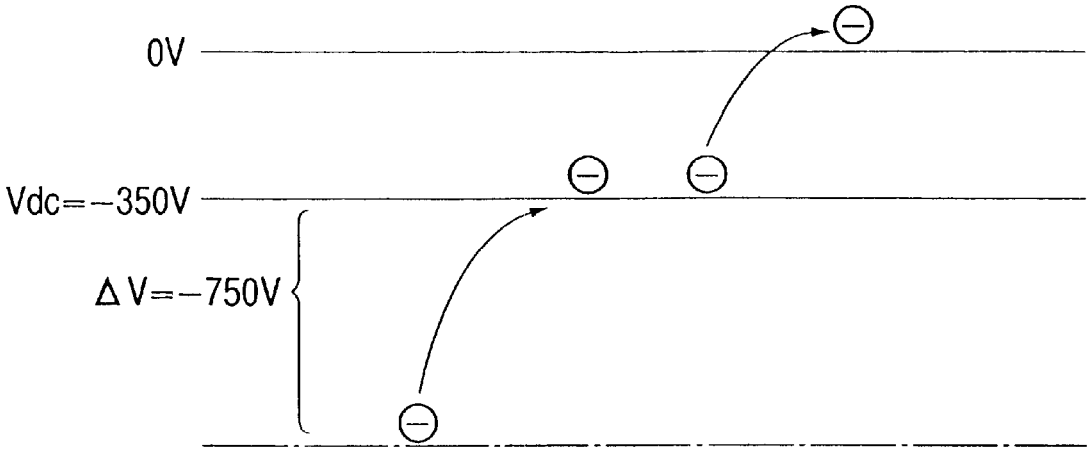
FIG. 6 is an explanatory view showing a bias at the time of toner supply of FIG. 5.

For example, as shown in FIG. 6, in the case where the developing bias is set at Vdc=−350 V, when such setting is made that the bias obtained by superposing the DC voltage of about $\Delta V=-750$ V through the power source 6 on the developing bias is applied to the toner supplying brush 4, since the charge of the toner is negative, the flying toner is attracted from the brush 4 to the developing roller 1 due to the action of the electric field caused by the difference (−750 V) of the DC voltage.

The toner supplied onto the developing roller 1 in this way is borne on the surface by the mirror force, and is carried to the toner regulating member 7 with the rotation of the developing roller 1. Thinning of a layer and application of a friction charging electric charge are performed by the toner regulating member 7 of the elastic member, so that a thin fine toner layer with a more uniform charging amount distribution is formed.

In this embodiment, therefore, the charged toner is made into a cloud and the toner is supplied to the developing roller 1 by the electric field in a noncontact manner, so that mechanical stress to the toner can be remarkably reduced, and only the sufficiently charged toner is supplied onto the developing roller 1 and is coated. Thus, a toner coat layer with an extremely sharp charging amount distribution and low deviation can be obtained. Accordingly, it becomes possible to realize development in which a high quality image can be stably obtained.

The toner having passed through the toner regulating member 7 is transferred and developed in accordance with an electrostatic latent image on the photosensitive drum 11 at a portion opposite to the photosensitive drum 11. The thus obtained toner image is carried to a transfer portion (not shown) with the rotation of the photosensitive drum 11, where the image is transferred onto a transfer material such as paper.

On the other hand, the toner which has not contributed to the development and has been returned into the developer container 3 while being borne on the developing roller 1 is stripped off from the developing roller 1 through the electric field formed at the abutment portion between the collecting roller 8 and the developing roller 1, and is borne and collected on the surface of the collecting roller 8. The borne toner is scraped by the scraper 9 disposed so as to abut against the surface of the collecting roller 8, and is returned to the developing step again.

Accordingly, since the cylindrical roller 8 rotating is used as the developer collecting member, a fresh electrode surface is always opposite to the surface of the developing roller 1, and a stable electric field is always formed between the developing roller 1 and the roller 8. Thus, collecting efficiency of the toner from the developing roller 1 becomes high.

Besides, since the development residual toner is certainly scraped by the scraper 9 every rotation of the developing roller 1, heat accumulation due to continuous frictional slide to the photosensitive drum 11, which conventionally occurs at development, will be suppressed, and abrupt toner deterioration can be prevented.

Embodiment 2

Figure 7:
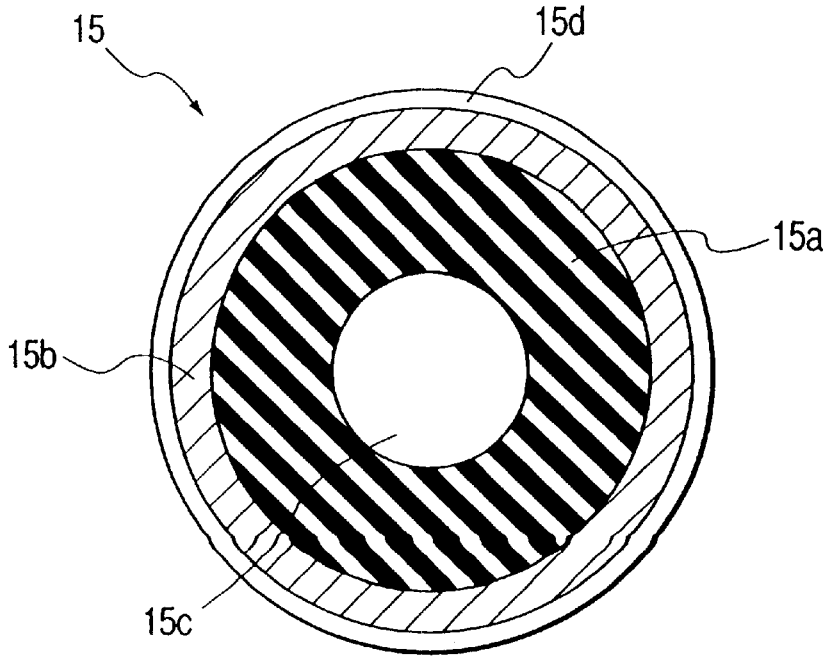
FIG. 7 is a sectional view showing a developing roller according to another embodiment of the present invention.
Figure 8:
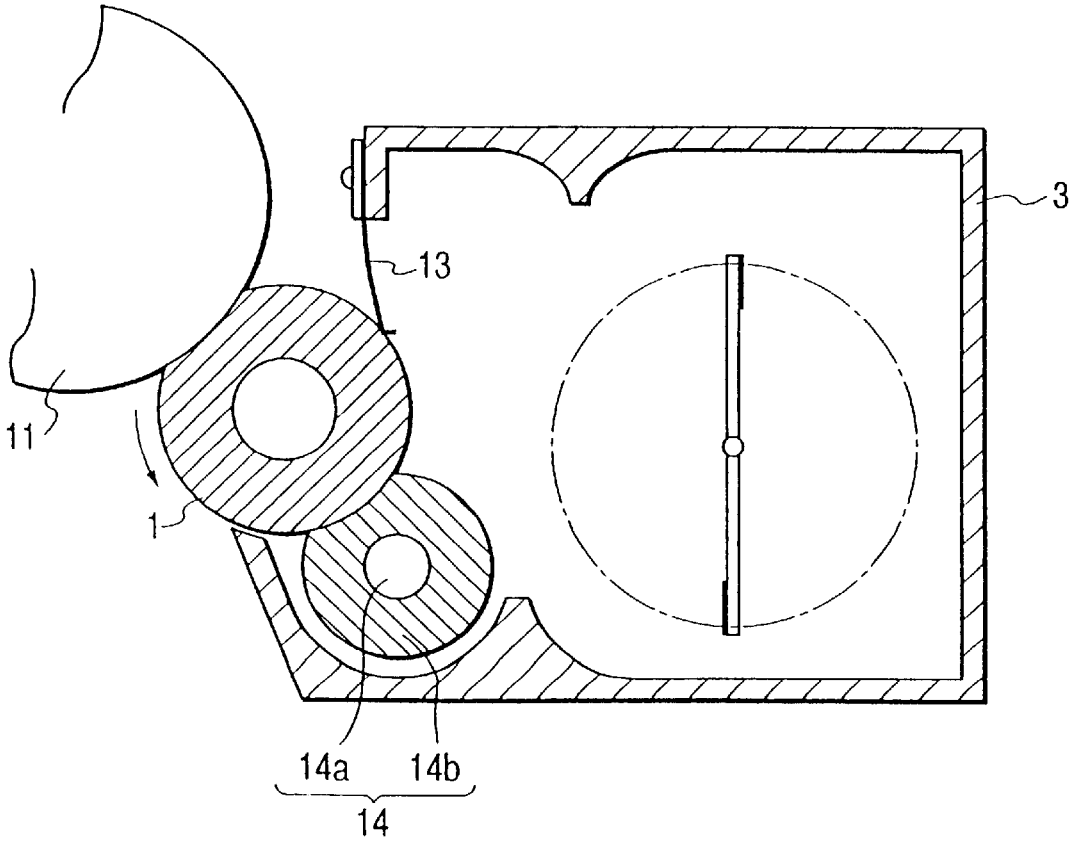
FIG. 8 PRIOR ART
FIG. 8 is a sectional view showing a developing apparatus.

FIG. 7 is a sectional view showing a developing roller according to another embodiment of the present invention.

A developing roller having elasticity as a developer bearing body is not limited to the developing roller 1 having only one layer of the elastic layer 1*a* according to Embodiment 1 shown in FIG. 2, but may be a developing roller having a laminated elastic layer in which at least two kinds of elastic layers with different hardnesses are laminated as in this embodiment.

According to this embodiment, a developing roller 15 includes a metal core metal 15*c*, a low hardness elastic layer 15*a* with a hardness of about 30 to 60° (JISA) formed on the core metal 15*c*, and a high hardness elastic layer 15*b* with a hardness of 50 to 80° (JISA) formed on the low hardness elastic layer 15*a*. That is, the developing roller includes the two laminated elastic layers. Further, similarly to Embodiment 1, in view of the property of electric charge application to the toner, the surface of the upper elastic layer 15*b* is coated with a conductive resin film 15*d* formed by dispersing carbon or the like in a resin such as nylon. Such setting is made that the resistance of the laminated elastic layers 15*a* and 15*b* in total becomes about $10^3$ to $10^9$ Ωcm.

The upper elastic layer 15*b* is made of a general rubber material such as silicone rubber, NBR rubber, EPDM rubber, and urethane rubber similarly to Embodiment 1. The lower elastic layer 15*a* may be made of the rubber material as set forth above, as well as a sponge-like elastic material with desired hardness, whereby a satisfactory effect can also be achieved.

In the case where the developing roller 15 has only one elastic layer, with respect to the developing roller 15, when priority is given to contact pressure to the photosensitive drum 11, that is, when priority is given to securement of a developing nip, it is necessary to make the hardness of the elastic layer very low. However, the elastic layer with low hardness can be damaged at the time of contact with the regulating blade 7. On the contrary, when the hardness of the elastic layer is set while priority is given to prevention of damage of the elastic layer at the time of contact with the regulating blade 7, a satisfactory developing nip cannot be always obtained.

In this embodiment, as a countermeasure against the foregoing disadvantage, at least two layers of the low hardness elastic layer 15*a* and the high hardness elastic layer 15*b* are laminated as the elastic layer of the developing roller 15. With this, the contact pressure necessary for the developing roller 15 at the time of contact with the photosensitive drum 11 can be obtained by the elastic force of the lower low hardness elastic layer 15*a,* and damage to the developing roller 15 produced at the time of contact with the regulating blade 7 can be prevented by the upper high hardness elastic layer 15*b* to the utmost degree.

As described above, according to the embodiments, with respect to the developing roller having elasticity in the developer container, the toner supplying brush made of the brush roller in which fibers are implanted is disposed as the developer supplying member in a noncontact manner, the nonmagnetic toner of the one-component developer is taken in the fibers of the toner supplying brush to be carried to the developing roller, the toner is mechanically flicked out from the brush fibers to make a cloud by elastic force generated when the brush fibers come in contact with the developer flow passage controlling member and are then flicked, the toner flies in the space between the toner supplying brush and the developing roller, and the flying toner is supplied to the developing roller through an electric field formed in the space. Accordingly, it is possible to supply only the toner having a desired charge polarity and a desired amount of charging electric charge to the developing roller and to make coating by the regulating blade.

Therefore, stress to a toner as in the case where a toner supplying roller is brought into contact with a developing roller and the toner is supplied through frictional sliding can be greatly reduced. Besides, it is possible to selectively supply a toner with a suitable amount of electric charge from the cloud-like toner, so that electric charge application to the toner by the regulating blade may be low and the contact pressure of the regulating blade can be reduced.

Moreover, the development residual toner which has not contributed to development and has been returned together with the developing roller is electrostatically stripped off by the toner collecting roller disposed to be in contact with the developing roller and is returned in the developer container. Thus, it is possible to avoid the occurrence of such a case where the development residual toner repeatedly passes through the nip portion between the developing roller and the toner supplying brush, the nip portion between the developing roller and the regulating blade, and the contact portion between the developing roller and the photosensitive drum, so that continuous load application to the toner is eliminated, and embedding and deterioration of an external additive by heat accumulation or the like to the toner can be remarkably suppressed.

From the above, according to the developing apparatus of the embodiments, even by the nonmagnetic, one-component developing method, a high quality image without fog and the like can be obtained, and the developing apparatus can cope with the toner for low temperature fixation, and further, the developing apparatus can be used for a long term as a developing apparatus of toner replenishment type.

What is claimed is:

1. A developing apparatus comprising:

a developer bearing member for bearing a developer and carrying the developer to a developing portion, the developer borne on said developer bearing member contacting with an image bearing member at the developing portion;

clouding means for forming a developer cloud directed in a direction opposite to a moving direction of said developer bearing member, proximate to said developer bearing member; and coating means for coating said developer bearing member with the developer in the developer cloud by force of an electric field.

2. A developing apparatus according to claim 1, wherein the developer is a nonmagnetic, one-component developer.

3. A developing apparatus according to claim 1, wherein said developer bearing member includes an elastic layer on a surface thereof.

4. A developing apparatus according to claim 3, wherein said elastic layer has a hardness (JISA) of 20° to 70°.

5. A developing apparatus according to claim 3, wherein said elastic layer is coated with a material having a charge application property higher than said elastic layer with respect to the developer.

6. A developing apparatus according to claim 5, wherein said developer bearing member has a volume resistance of $10^3$ to $10^9$ Ωcm in total.

7. A developing apparatus according to claim 3, wherein said elastic layer includes a low hardness elastic layer with a hardness (JISA) of 30° to 60° and a high hardness elastic layer with a hardness (JISA) of 50° to 80° laminated thereon.

8. A developing apparatus according to claim 1, wherein a surface roughness Rz of said developer bearing member is set at 3 to 20 μm.

9. A developing apparatus comprising:

a developer bearing member for bearing a developer and carrying the developer to a developing portion, the developer borne on said developer bearing member contacting with an image bearing member at the developing portion;

clouding means for forming a developer cloud passing in the vicinity of said developer bearing member in a direction away from said developer bearing member; and coating means for coating said developer bearing member with the developer in the developer cloud by force of an electric field.

10. A developing apparatus according to claim 9, wherein the developer is a nonmagnetic, one-component developer.

11. A developer apparatus according to claim 9, wherein said developer bearing member includes an elastic layer on a surface thereof.

12. A developing apparatus according to claim 11, wherein said elastic layer has a hardness (JISA) of 20° to 70°.

13. A developing apparatus according to claim 11, wherein said elastic layer is coated with a material having a charge application property higher than said elastic layer with respect to the developer.

14. A developing apparatus according to claim 13, wherein said developer bearing member has a volume resistance of $10^3$ to $10^9$ Ωcm in total.

15. A developing apparatus according to claim 11, wherein said elastic layer includes a low hardness elastic layer with a hardness (JISA).

16. A. developing apparatus according to claim 9, wherein a surface roughness Rz of said developer bearing body is set at 3 to 20 μm.

17. A developing apparatus comprising:

a developer bearing member for bearing a developer and carrying the developer to a developing portion, the developer borne on said developer bearing member contacting with an image bearing member at the developing portion;

a movable member provided in a noncontact state to said developer bearing member, said movable member moving while bearing the developer supplied to said developer bearing member;

a tapped member arranged to be tapped by said movable member, thereby forms a developer cloud being from said movable member, and the developer cloud passing between said developer bearing member and said movable member; and coating means for coating said developer bearing member with the developer in the developer cloud by force of an electric field generated between said developer bearing member and said movable member.

18. A developing apparatus according to claim 17, wherein the developer is a nonmagnetic, one-component developer.

19. A developer apparatus according to claim 17, wherein said developer is a nonmagnetic, one-component developer.

20. A developing apparatus according to claim 19, wherein said elastic layer has a hardness (JISA) of 20° to 70°.

21. A developing apparatus according to claim 19, wherein said elastic layer is coated with a material having a charge application property higher than said elastic layer with respect to the developer.

22. A developing apparatus according to claim 21, wherein said developer bearing member has a volume resistance of $10^3$ to $10^9$ Ωcm in total.

23. A developing apparatus according to claim 19, wherein said elastic layer includes a low hardness elastic layer with a hardness (JISA) of 30° to 60°0 and a high hardness elastic layer with a hardness (JISA) of 50° to 80° laminated thereon.

24. A developing apparatus according to claim 17, wherein a surface roughness Rz of said developer bearing member is set at 3 to 02 Ωm.

* * * * *

UNITED STATES PATENT AND TRADEMARK OFFICE

CERTIFICATE OF CORRECTION

PATENT NO. : 6,321,057 B1
DATED : November 20, 2001
INVENTOR(S) : Takeshi Yamamoto It is certified that error appears in the above-identified patent and that said Letters Patent is hereby corrected as shown below:

Column 2,
Line 35, “can not” should read -- cannot --.

Column 3,
Line 10, “magnetic” should read -- magnetic, --.

Column 4,
Line 34, “1ais” should read -- 1a is --.

Column 5,
Line 3, “1 a” should read -- 1a --; and
Line 21, “i.e.,” should read -- (i.e., --.

Column 6,
Line 12, “thin” should read -- a thin --.

Column 7,
Line 57, “born” should read -- borne --.

Column 11,
Lines 3 and 11, “developer” should read -- developing --;
Line 18, “hardness (JISA).” should read -- hardness (JISA) of 38º to 60º --;
Line 19, “A.” should read -- A --; and
Line 33, “forms” should read -- forming --.

UNITED STATES PATENT AND TRADEMARK OFFICE

CERTIFICATE OF CORRECTION

PATENT NO. : 6,321,057 B1
DATED : November 20, 2001
INVENTOR(S) : Takeshi Yamamoto It is certified that error appears in the above-identified patent and that said Letters Patent is hereby corrected as shown below:

Column 12,
Line 11, "developer" should read -- developing --;
Line 26, "60ºO" should read -- 60º --; and
Line 31, "02Ωm." should read -- 20 $\mu$m. --.

Signed and Sealed this

Sixteenth Day of July, 2002

*Attest:*

*Attesting Officer*

JAMES E. ROGAN
*Director of the United States Patent and Trademark Office*